US012349820B2

(12) United States Patent
Buerck et al.

(10) Patent No.: US 12,349,820 B2
(45) Date of Patent: Jul. 8, 2025

(54) GARMENT ASSEMBLY AND RELEASE APPARATUS AND METHOD

(71) Applicant: FirstSpear, LLC, Fenton, MO (US)

(72) Inventors: Trevor S. Buerck, Imperial, MO (US); Scott J. Carver, Manchester, MO (US); Michael E. Cole, Ste. Genevieve, MO (US)

(73) Assignee: FirstSpear Technology Group, LLC, Fenton, MO (US)

( * ) Notice: Subject to any disclaimer, the term of this patent is extended or adjusted under 35 U.S.C. 154(b) by 1207 days.

(21) Appl. No.: 16/105,638

(22) Filed: Aug. 20, 2018

(65) Prior Publication Data

US 2019/0000252 A1 Jan. 3, 2019

Related U.S. Application Data

(62) Division of application No. 14/358,640, filed as application No. PCT/US2012/065854 on Nov. 19, 2012, now Pat. No. 10,051,984.

(60) Provisional application No. 61/561,802, filed on Nov. 18, 2011.

(51) Int. Cl.

| | |
|---|---|
| ***A47G 25/90*** | (2006.01) |
| ***A41F 1/00*** | (2006.01) |
| ***A44B 11/25*** | (2006.01) |
| ***F41H 1/02*** | (2006.01) |

(52) U.S. Cl.

CPC ..... *A47G 25/90* (2013.01); *A41F 1/00* (2013.01); *A44B 11/2596* (2013.01); *F41H 1/02* (2013.01); *A41D 2300/30* (2013.01); *A41D 2300/50* (2013.01); *A41D 2400/44* (2013.01); *Y10T 24/346* (2015.01)

(58) Field of Classification Search

CPC ..... A41F 1/00; F41H 1/02; A41D 2300/30; A41D 2300/50; A44B 11/2596

USPC ..... 2/102

See application file for complete search history.

(56) References Cited

U.S. PATENT DOCUMENTS

| | | | |
|---|---|---|---|
| 3,979,801 | A | 9/1976 | Tareau |
| 4,054,972 | A | 10/1977 | Rowell |
| 4,502,191 | A | 3/1985 | Savage |

(Continued)

FOREIGN PATENT DOCUMENTS

| | | | | |
|---|---|---|---|---|
| EP | 0287060 | A1 | 10/1988 | |
| EP | 2363034 | A1 * | 9/2011 | ..... A44B 11/008 |

(Continued)

*Primary Examiner* — Alissa J Tompkins
*Assistant Examiner* — Catherine M Ferreira
(74) *Attorney, Agent, or Firm* — Matthews Edwards LLC

(57) ABSTRACT

A vest utilizing an assembly and release apparatus and method incorporating a C-shaped clip defining a channel and a smaller slot extending along the channel, attachable to a first location on the vest. A pin of the apparatus is slidably receivable in the channel through the open end to assemble the C-shaped clip and the pin together. The pin has a tab or strip that extends through the slot, for attaching the pin to a second location on the vest. The apparatus includes at least one detent element associated with one of the C-shaped clip and the pin, cooperatively engageable with the other of the C-shaped clip and the pin for retaining the pin in the channel, and releasable in a predetermined manner to allow slidably removing the pin from the channel to provide a quiet and rapid manner of operation.

22 Claims, 13 Drawing Sheets

(56) References Cited

U.S. PATENT DOCUMENTS

| | | | | |
|---|---|---|---|---|
| 4,777,665 | A | 10/1988 | Akamatsu | |
| 4,790,050 | A | 12/1988 | Ishii | |
| 4,935,996 | A | 6/1990 | Ferrara | |
| 4,944,072 | A * | 7/1990 | Robson | A44B 19/16 24/585.12 |
| 5,369,854 | A | 12/1994 | Stephens | |
| 5,671,516 | A | 9/1997 | Sartori | |
| 5,878,467 | A * | 3/1999 | Yokota | A44B 19/262 24/429 |
| 6,009,604 | A | 1/2000 | Fildan | |
| 6,487,759 | B1 * | 12/2002 | Akeno | A44B 11/2592 24/399 |
| 7,047,570 | B2 | 5/2006 | Johnson | |
| 7,238,081 | B2 | 7/2007 | Fildan | |
| 7,480,967 | B2 | 1/2009 | Kojoori | |
| 7,636,989 | B2 * | 12/2009 | Plourde | B65D 33/007 24/585.12 |
| 7,814,567 | B2 * | 10/2010 | Dovner | F41H 1/02 2/2.5 |
| 7,979,917 | B2 | 7/2011 | Osborne | |
| 7,987,523 | B2 | 8/2011 | Cole et al. | |
| 8,056,296 | B2 | 11/2011 | Sample et al. | |
| 8,359,716 | B2 | 1/2013 | Fiedler | |
| 10,316,887 | B2 * | 6/2019 | Iannello | F16B 7/00 |
| 11,064,771 | B1 * | 7/2021 | Lovato | A41F 1/00 |
| 2008/0246326 | A1 * | 10/2008 | Lichtner | A47D 15/006 2/102 |
| 2009/0094809 | A1 | 4/2009 | Kung | |
| 2010/0235957 | A1 * | 9/2010 | Dovner | F41H 1/02 2/2.5 |
| 2014/0341639 | A1 | 11/2014 | Iannello | |

FOREIGN PATENT DOCUMENTS

| | | | |
|---|---|---|---|
| FR | 2290860 | A1 | 6/1976 |
| GB | 663482 | A | 12/1951 |
| GB | 2079359 | A | 1/1982 |
| WO | 2013109587 | A1 | 7/2013 |

* cited by examiner

GARMENT ASSEMBLY AND RELEASE APPARATUS AND METHOD

This application is a division of co-pending U.S. patent application Ser. No. 14/358,640, filed May 15, 2014, which application was submitted under 35 U.S.C. 371 claiming priority to PCT/US2012/65854, filed Nov. 19, 2012, which application claims the benefit of U.S. Provisional Application No. 61/561,802, filed Nov. 18, 2011.

TECHNICAL FIELD

The present invention relates generally to assembly and release apparatus and method for a garment such as a ballistic vest or the like, and more particularly, which provides a quiet and rapid manner of donning and doffing the garment, so as to be usable for both standard doffing and donning, and rapid release for emergency and injury situations and the like.

BACKGROUND ART

The disclosures of co-pending patent application Ser. No. 14/358,640, filed May 15, 2014, PCT application Ser. No. PCT/US2012/65854, filed Nov. 19, 2012, and U.S. Provisional Application No. 61/561,802, filed Nov. 18, 2011, are incorporated herein by reference in their entirety.

There has long been various garments, such as, but not limited to, vests, particularly those used in tactical and military operations, such as ballistic vests including armor, that have apparatus for assembling and securely holding the garment on or about the user's body. Known ballistic vests in particular often have complex systems for placing and assembling the vest about the body, herein also referred to as doffing the vest or garment, typically utilizing a complex system of belts and straps that take significant time and familiarity to assemble and adjust, and for removing or doffing it. As a result, there has also long been apparatus and systems for rapid removal of garments such as ballistic vests in emergency situations such as combat to enable inspecting and treating injuries to the wearer's body, and to facilitate escape from dangerous situations such as immersion in water. These rapid removal apparatus and systems are typically in addition, but often connected, to the apparatus or systems for donning and doffing the garment.

Reference in this regard, the ballistic vest disclosed in U.S. Pat. No. 7,047,570, which discloses front and rear portions that can separate completely from one another, while a waist belt and cummerbund of the vest have an end that separates from at least one of the front and rear portions. This vest uses a complex system of belting and straps for normal donning and doffing. Because of this complexity, a rapid release system is provided which utilizes a flexible retainer including a cable that can be quickly pulled to break the vest into pieces for removal. However, a disadvantage of this system is that once it is used, reassembly of the vest and rigging of the rapid release system is time consuming and involves threading portions of the retainer through regions of the vest, which can be difficult, particularly under challenging condition such as darkness and combat, and during which assembly the user is left unprotected. As another disadvantage, because an additional system is used for rapid release, the vest is heavier than desired.

Reference also the ballistic vest disclosed in U.S. Pat. No. 7,979,917, which discloses a rear break away feature, but suffers from similar disadvantages, namely, the feature is in additional to the elements for normal donning and doffing the vest; complexity; time consuming reassembly; and additional weight.

Reference also U.S. Pat. No. 7,987,523 which discloses a quick release garment which is also a ballistic vest, that utilizes a flexible retainer similar to that of U.S. Pat. No. 7,047,570, but which does not result in complete separation of components of the vest when the quick release feature is used. However, it still requires additional apparatus for quick release; is complex, heavy, and time consuming to reassemble.

Reference further, U.S. Pat. No. 8,056,196 which discloses a quick release fitting having utility for use in garments such as ballistic vests and the like, that would eliminate one or more of the disadvantages set forth above, namely, the requirement for additional apparatus for rapid release, but which is potentially disadvantageous as it utilizes a relatively complex multiple spring loaded release mechanism that could malfunction in dirty and other adverse environments.

Thus, what is sought is an assembly and release apparatus and method for a garment such as a ballistic vest or the like, that provides a quiet and rapid manner operation, usable for both standard donning and doffing, as well as rapid release, and which provides at least some weight advantage, and overcomes one or more of the disadvantages set forth above.

SUMMARY OF THE INVENTION

What is disclosed is an assembly and release apparatus and method for a garment such as a ballistic vest or the like, that provides a quiet and rapid manner operation, usable for both standard donning and doffing, as well as rapid release, and which provides at least some weight advantage, and overcomes one or more of the disadvantages set forth above.

According to a preferred aspect of the invention, the apparatus includes a C-shaped clip defining a channel and an open slot extending along the channel, open at at least one end of the clip, and including at least one element configured for attaching the C-shaped clip to a first location on the garment. The apparatus includes a pin slidably receivable in the channel of the C-shaped clip through the open end to assemble the C-shaped clip and the pin together. The pin has a tab or strip configured to extend through the slot, for attaching the pin to a second location on the garment, the slot being sufficiently small to prevent passage of the pin therethrough. The apparatus additionally includes at least one detent element associated with one of the C-shaped clip and the pin, cooperatively engageable with the other of the C-shaped clip and the pin for retaining the pin in the channel, the detent element being releasable in a predetermined manner to allow slidably removing the pin from the channel through the open end.

In a preferred manner of operation, with the C-shaped clip attached to the first location on the garment, and the pin attached to the second location, the pin can be slidably inserted into the channel of the C-shaped clip, and the detent element or elements engaged, to securely hold the locations of the garment together. Separating the locations entails simply releasing the detent element or elements. A preferred garment is a ballistic vest, and the locations can comprise, for instance, but are not limited to, and edge or edges of a front panel of the vest, and side elements such as a belt or cummerbund, and also an upper edge of the front panel and a shoulder strap or straps. As a result, the pin can be engaged with and disengaged from the clip quickly and easily so that the garment can be donned and doffed rapidly, which is a valuable advantage under the conditions set forth above.

According to one preferred embodiment, the at least one detent element comprises a tab extending from the C-shape clip, cooperatively engageable with or receivable in a receptacle in the pin, and removable therefrom in a predetermined motion, such as with a convenient and simple manual pulling motion, which can be accomplished under stressful and low visibility conditions. The C-shaped clip and the pin can be elongate, and the tab located at about a central portion of the C-shaped clip. Additionally the assembled clip and pin can be generally flat, so as to not be obtrusive. As an alternative construction, the detent element can comprise a cover, e.g., of a fabric material, over the open end or ends of the C-shaped clip, and which can be easily grasped and moved using a finger or fingers, so as to also be quickly and simply accomplished. In this regard, the clip and/or the pin can be fabric covered, e.g., with a camouflage fabric if desired.

As another preferred aspect of the invention, the channel of the C-shaped clip and the pin have mating D-shapes when viewed from the end thereof, with flat surfaces of the D-shape being located adjacent to opposite sides of the slot, for added strength, and to improve tactile feel for assembly under low light and other difficult conditions.

As still another preferred aspect of the invention, the C-shaped clip and the pin have mating surfaces bounding the channel adjacent to at least one side of the slot, which are tapered at less than a 90 degree angle, e.g., 75-85 degrees, to the slot such that when the pin is located in the channel and a force is exerted against the tab or strip in a direction to pull the pin toward or through the slot, the surface of the clip adjacent to the slot will be drawn toward the slot to prevent passage of the pin therethrough. This feature can be incorporated with the D-shaped feature discussed above, and can be located on opposite sides of the slot, for greater strength.

DETAILED DESCRIPTION OF THE INVENTION

Referring to FIGS. 1 through 8, assembly and release apparatus 20 constructed and operable according to the teachings of the present invention, are shown at several location on a representative garment, which here is a ballistic vest 36, that provides a quiet and rapid manner of operation, usable for both standard donning and doffing, as well as rapid release, and which provides at least some weight advantage, and overcomes one or more of the disadvantages set forth above.

Figure 1:
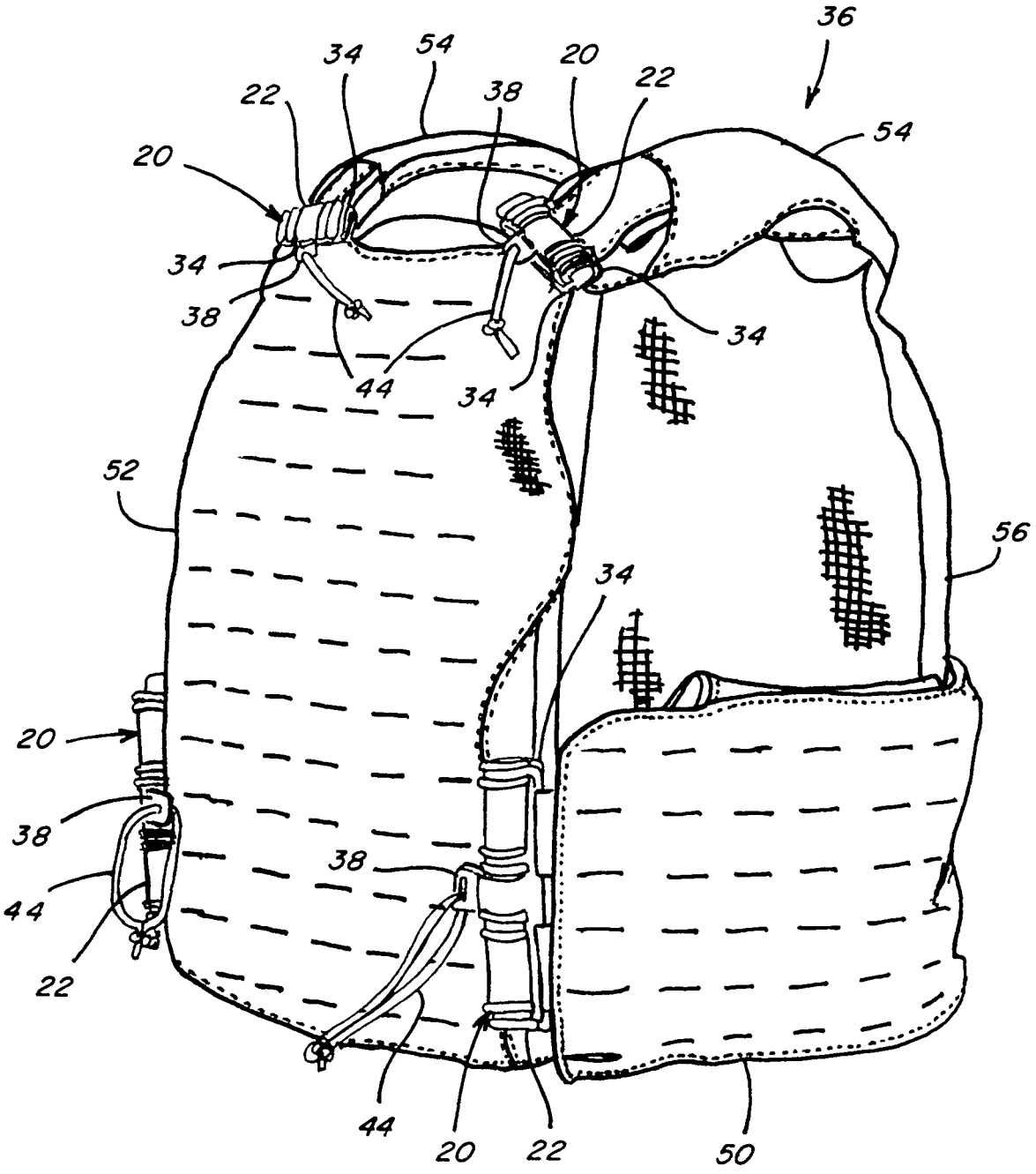
FIG. 1 is a perspective view of a representative garment which is a ballistic vest including assembly and release apparatus of the invention connecting elements of the vest together.
Figure 2:
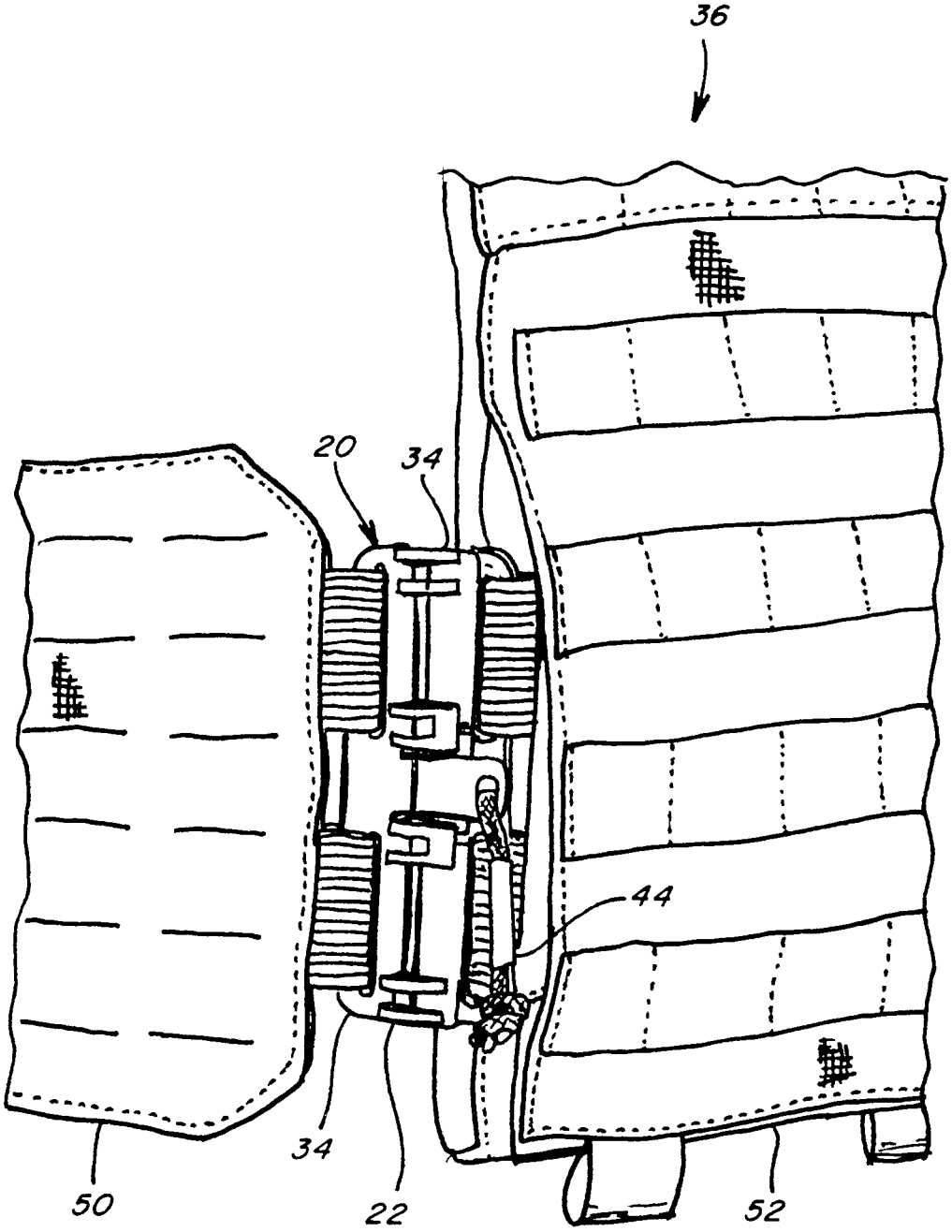
FIG. 2 is an enlarged fragmentary perspective view of the vest of FIG. 1 showing one of the assembly and release apparatus connecting a front panel and a cummerbund of the vest together.
Figure 3:
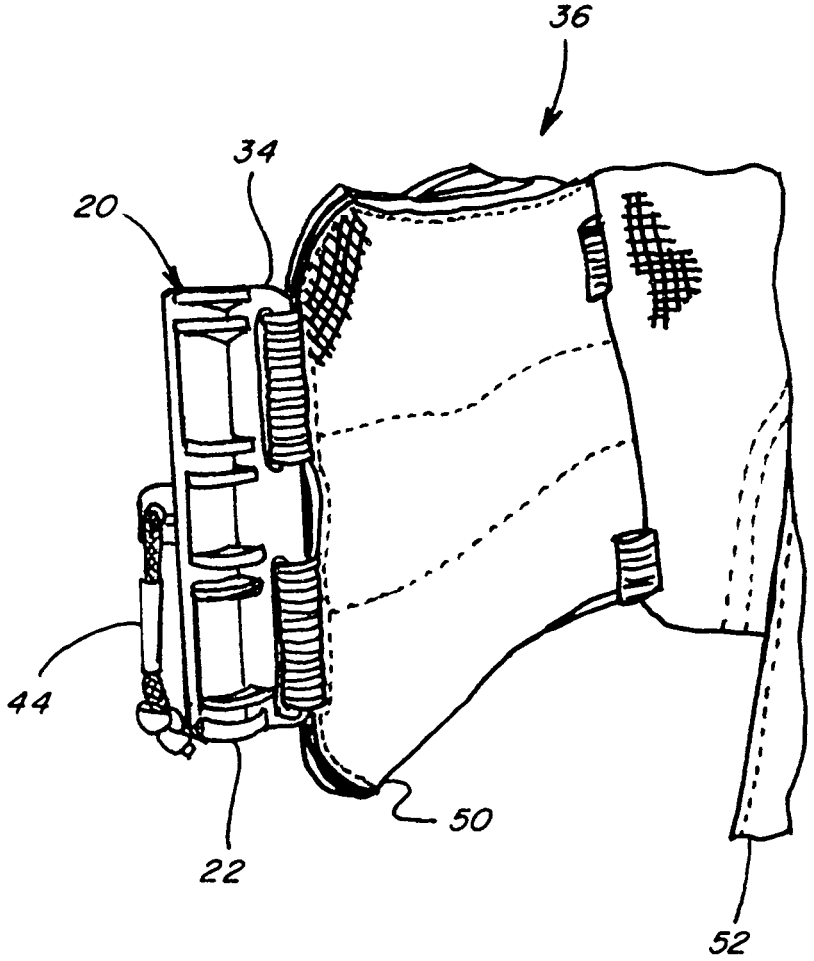
FIG. 3 is another fragmentary perspective view of the vest, showing aspects of the invention on the cummerbund.
Figure 4:
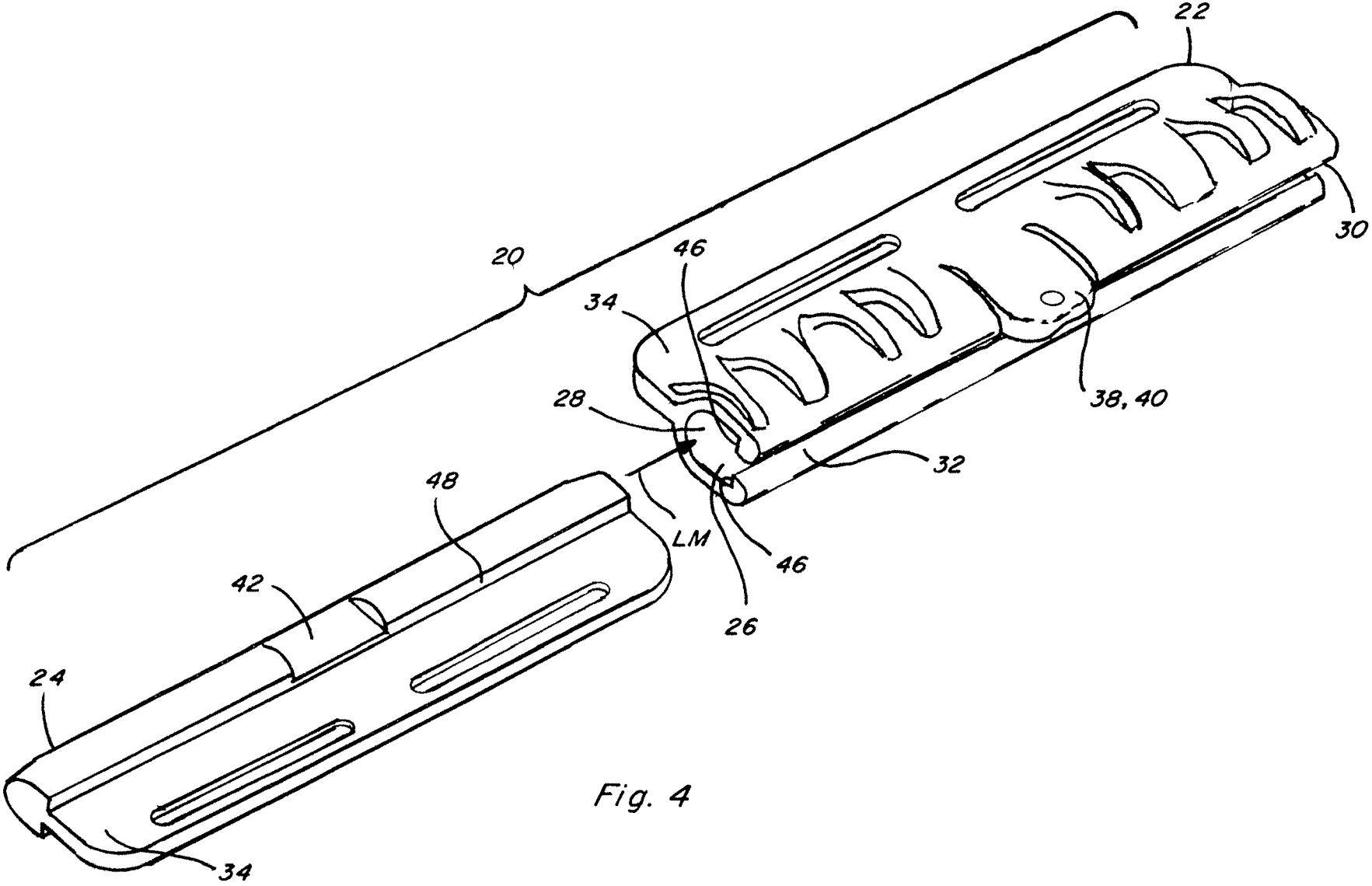
FIG. 4 is perspective view of a representative assembly and release apparatus of the invention, shown in a disassembled state.

The assembly and release apparatus 20 includes a C-shape female clip 22 which is attached to a first element or location of the garment to be connected to another element or location, and an elongate male pin 24 attached to the second element or section and with relative longitudinal movement as denoted by arrow LM in FIG. 4, is cooperatively receivable in the C-shape clip 22 for connecting the garment element or sections together. As best shown in FIGS. 4-7, the C shape clip 22 extends partially circumferentially about and defines an elongate channel 26 open at at least one longitudinal end 28, 30 for receiving the elongate pin 24, and has a longitudinally extending slot 32 along the channel 26 also.

Figure 6:
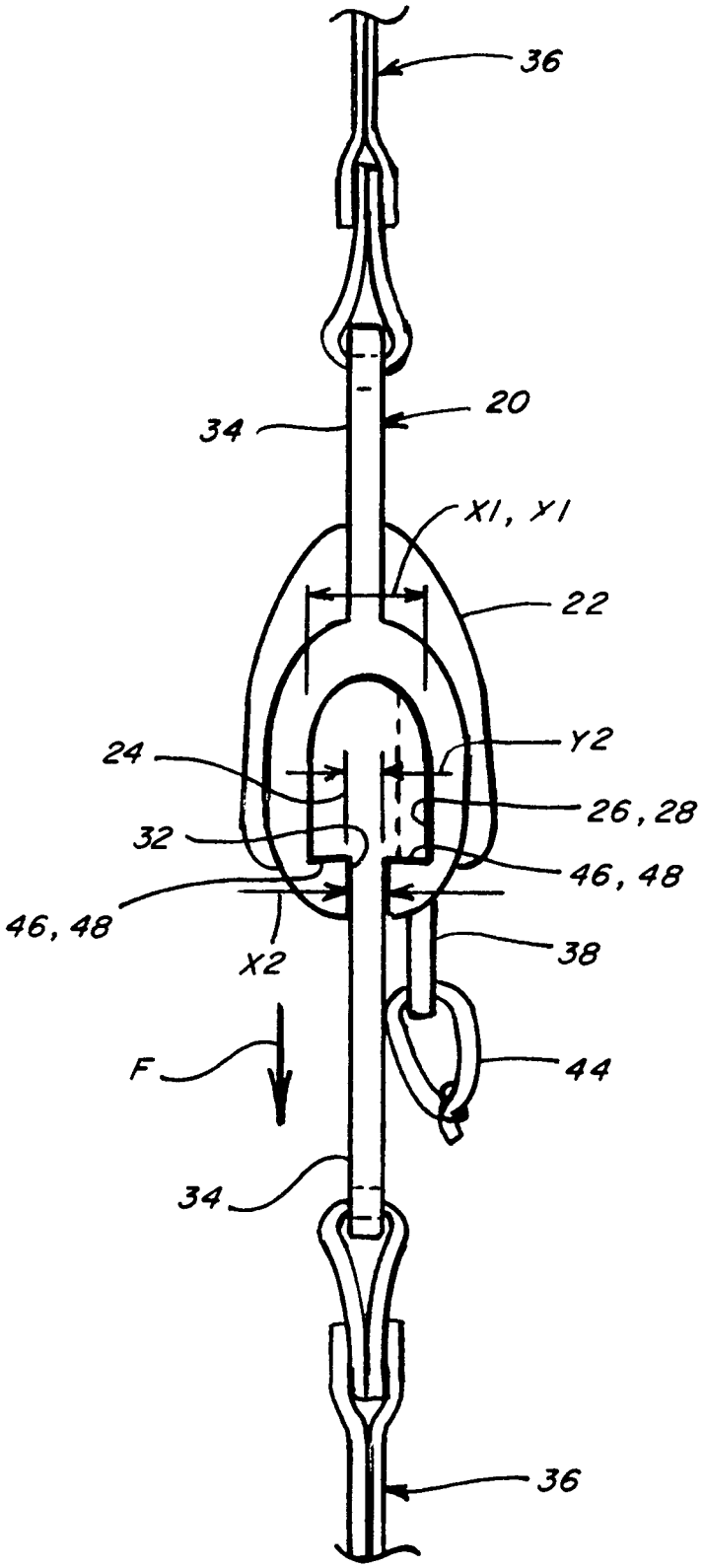
FIG. 6 is an end view of the apparatus of the invention, showing a detent element of the invention in an engaged state for retaining a pin of the apparatus.

Both the C-shape clip 22 and the pin 24 are preferably attached to its respective element or location of the garment (vest 36) by at least one tab or strip 34 that extends longitudinally along the clip 22 or pin 24, and the tab or strip 34 of the pin 24 is cooperatively received in the slot 32 of the clip 22. As best shown in FIG. 6, the pin 24 preferably has a sectional extent X1 transverse to the longitudinal direction that about equal to or only marginally smaller than the transverse extent Y1 of the channel, so that the pin 24 is relatively easily slidable along the channel 26 by movement LM, but not loose. The slot 32 is just sufficient in width Y2 to receive the tab or strip 34, which is relatively narrow in thickness (X2) transverse to the longitudinal direction, but not large enough for passage of the pin 24 transversely from the channel 26. The channel 26 and pin 24 can have substantially mating cross sectional shapes, such as, but not limited to, a round shape, or a D-shape, as desired or required for a particular application.

The C-shape clip 22 is preferably sufficiently strong and rigid so as to resist breaking or deforming under forces anticipated to be exerted thereagainst, so as to be capable of restraining the pin 24 from transverse removal therefrom through the slot 32 under transverse and other forces anticipated to be exerted during use of the garment, as denoted by arrow F in FIG. 6. Suitable materials for both clip 22 and pin 24 can include metals and strong plastics such as a nylon or fiber reinforced resin. Such forces can vary and may be specifically designated in a performance specification for the particular garment, e.g., a ballistic vest 36 or other garment for military or law enforcement use.

Figure 5:
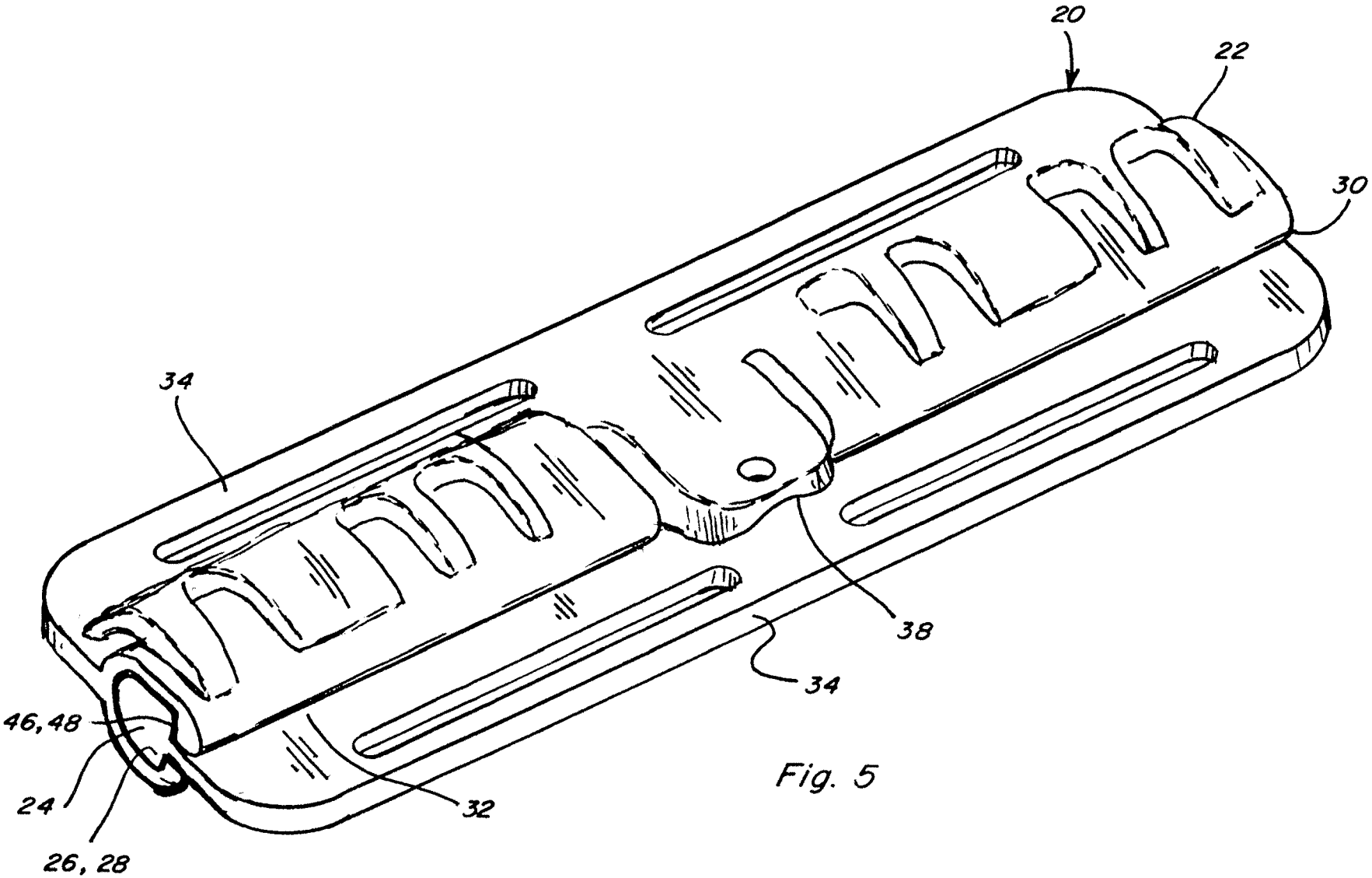
FIG. 5 is an enlarged perspective of the representative assembly and release apparatus of the invention, shown in an assembled state.
Figure 7:
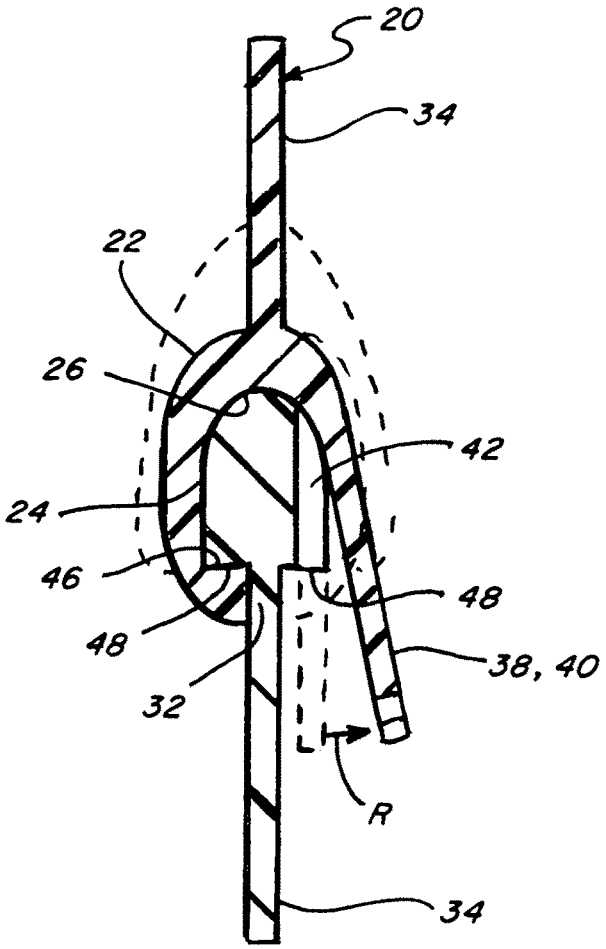
FIG. 7 is an enlarged sectional view of the apparatus, showing the detent element of the invention in a release state for allowing removal of the pin.
Figure 8:
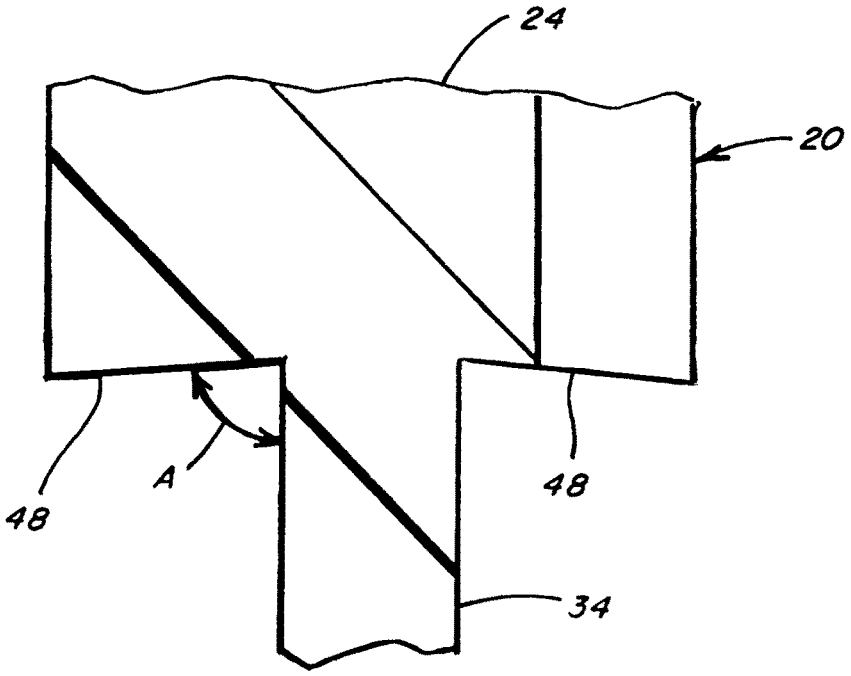
FIG. 8 is an enlarged fragmentary sectional view of a detail of the apparatus of the invention.

Release apparatus 20 additionally includes at least one detent element 38 configured and operable for retaining pin 24 in the longitudinal direction in channel 26 under forces anticipated to be exerted thereagainst during use of the garment, but which detent element is movable or deformable in a predetermined manner, e.g., by manual manipulation, to allow removal of the pin 24. As a non-limiting example, as best shown in FIGS. 4, 5, and 7, the detent element 38 is connected in cantilever relation to C-shaped clip 22 to extend in a side direction therefrom, and including a transversely extending tab 40 cooperatively receivable in a notch 42 in pin 24, both of which can be located along the respective lengths thereof, here, at a center or middle location along the lengths of the clip and pin, between longitudinally spaced portions of the C-shaped clip 22. A convenient graspable feature, such as a fabric loop or cord 44 or the like, can be provided in connection with tab 40 to facilitate manually grasping tab 40 and pulling it transversely away from notch 42 when it is desired to release the pin, as denoted by arrow R in FIG. 7.

As another feature, C-shaped clip 22 and pin 24 preferably have mating surfaces 46, 48 bounding the channel adjacent to at least one side of the slot (here on both sides), which are tapered at less than a 90 degree angle A (FIG. 8), e.g., 75-85 degrees, to strip 34 (and slot 32) such that when pin 24 is located in channel 26 and a force F (FIG. 6) is exerted against tab or strip 34 in a direction to pull pin 24 toward or through slot 32, surfaces 48 of pin 24 will push against and draw surfaces 46 of the clip toward the slot to prevent passage of the pin therethrough for additional strength.

Figure 9:
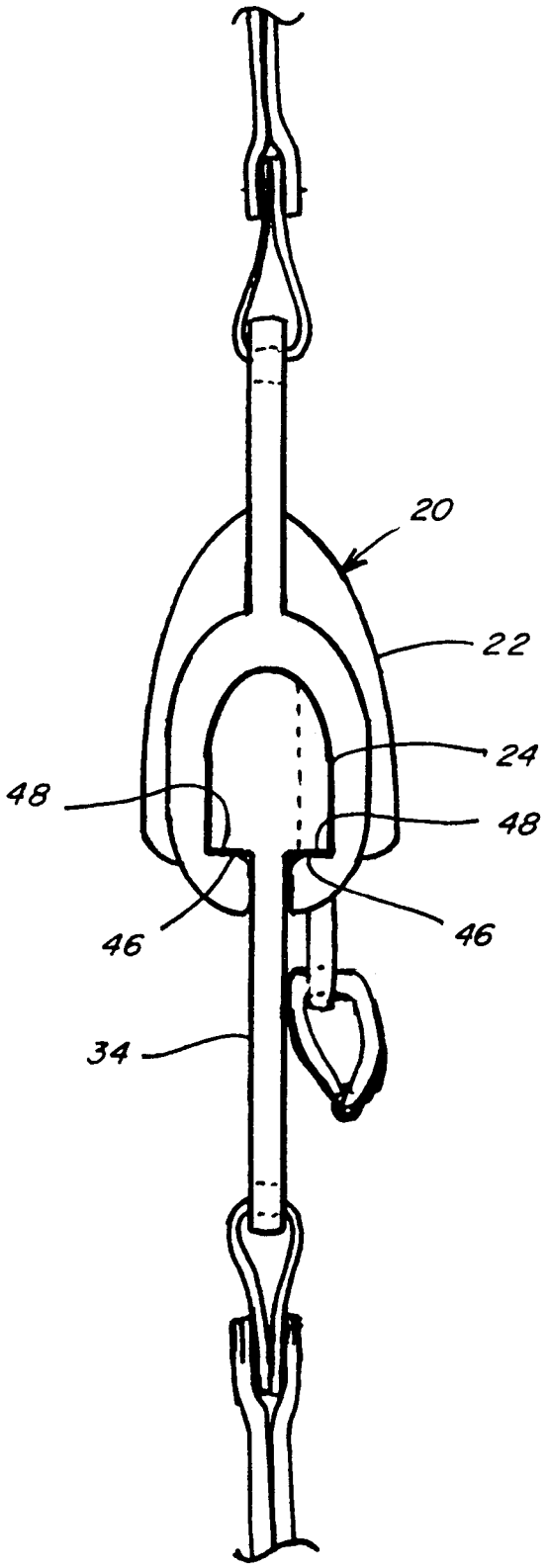
FIG. 9 is an end view of an alternative embodiment of the invention.
Figure 10:
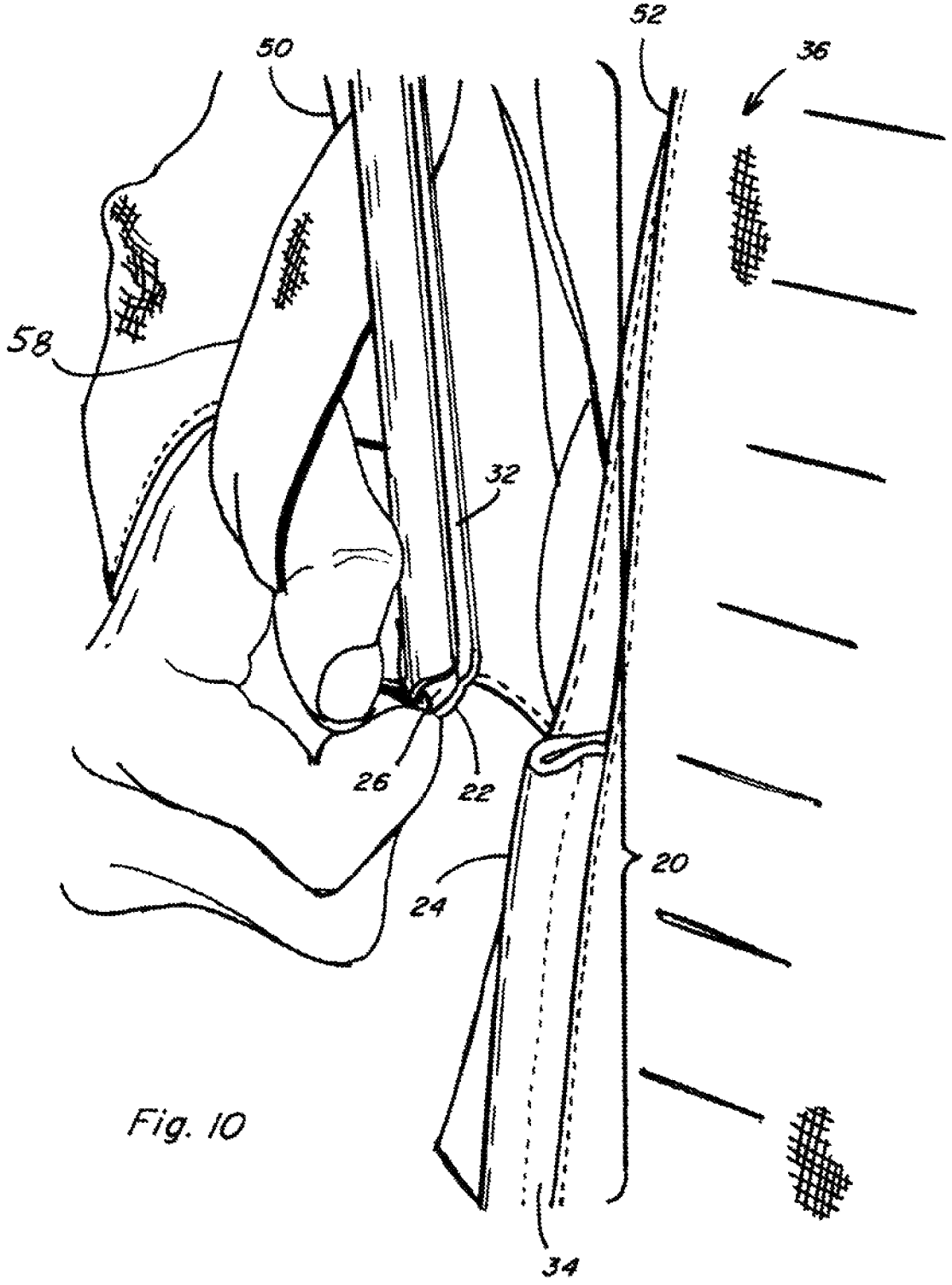
FIG. 10 is an enlarged fragmentary perspective view of the vest, showing another alternative embodiment of assembly and release apparatus of the invention for connecting elements of the vest, namely a cummerbund and front panel.

Referring also to FIG. 9, as an alternative construction of clip 22 and pin 24 of apparatus 20, surfaces 46 and 48 can be about perpendicular to slot 32 and strip 34, if desired.

Here, it should be noted that the assembly and release apparatus of the invention can be incorporated at various locations on a garment, such as, but not limited to, for connecting a belt or cummerbund 50 to a side edge of a front panel 52 of a ballistic vest 36, as shown in various of the FIGS. Another location is for connecting the upper edge of front panel 52 to shoulder straps 54, as also shown. Still other locations can include cummerbund or belt to a side edge of a rear panel 56 of the vest, and/or shoulder strap to rear panel, to name a few options. As illustrated, apparatus 20 can be sized accordingly for a particular location, to provide the required strength. Additionally, the clip 22 and pin 24 can be attached to the side of the connection that is most advantageous, as desired or required for the application. As non limiting examples, the C-shaped clips 22 can be located on cummerbund 50 and shoulder straps 54, and pins 24 on front panel 54, or vice versa.

Referring also to FIGS. 10-14, an alternative embodiment of assembly and release apparatus 20 is shown, wherein C-shaped clip 22 and pin 24 are still of a rigid material such as nylon, reinforced resin, or metal, but can be fabric covered if desired or required for a particular application. Channel 26 is similarly configured, positioned, and operable as discussed above, as is slot 32, such that assembly and release is essentially the same. That is, pin 24 is longitudinally received in channel 26 of clip 22, with strip 34 extending through slot 34 as illustrated. Assembly requires relative longitudinal movement as denoted by arrow LM in FIG. 11, as can be effected manually, for instance using a finger through an associated loop 58 on one of the elements to be connected. This will require offsetting the two elements of the garment during the initial alignment, e.g., lifting or shifting one relative to the other, then sliding them into alignment as the pin is slid into the clip.

Figure 11:
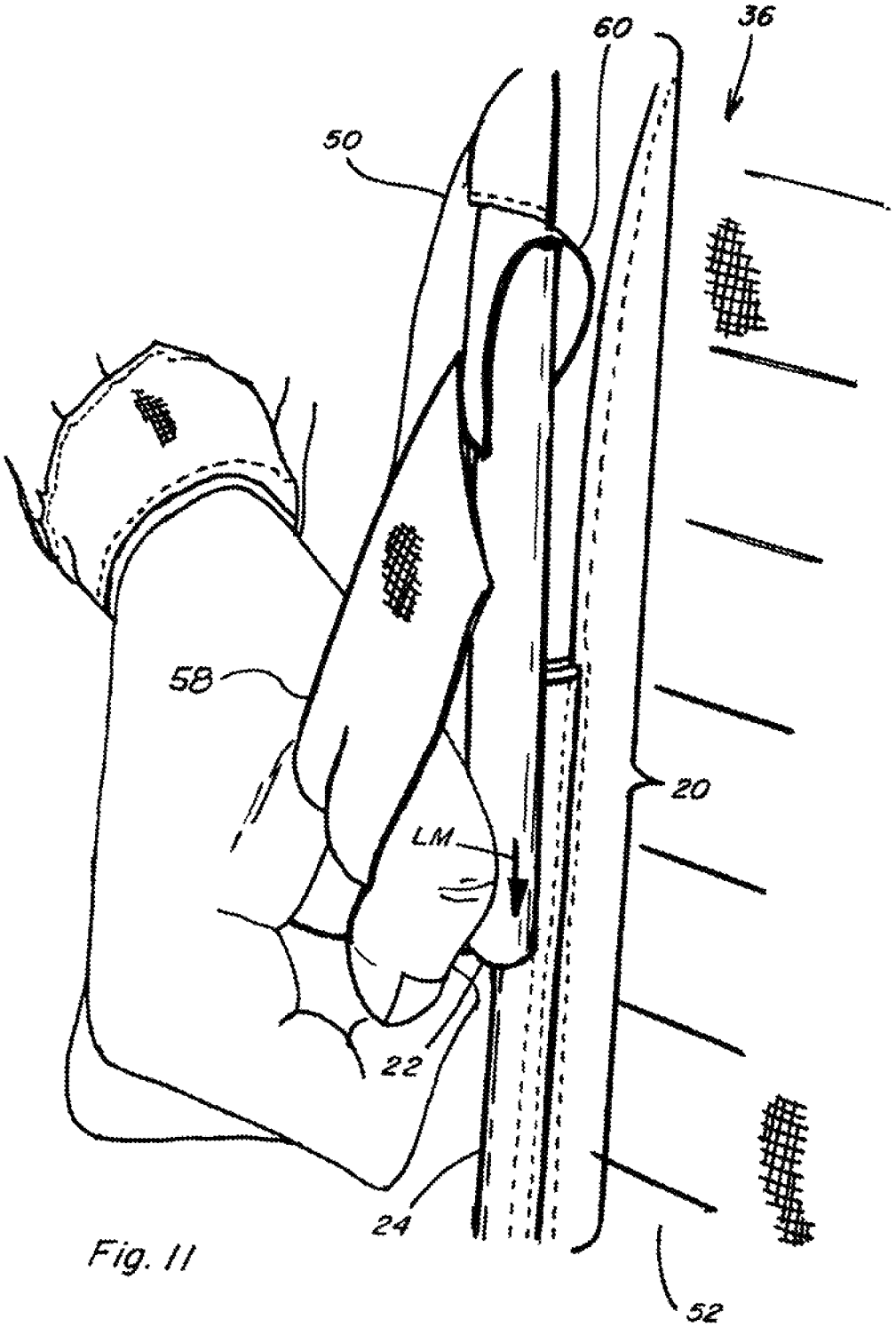
FIG. 11 is another enlarged fragmentary perspective view of the vest of FIG. 10, showing the apparatus of the invention partially assembled for connecting the cummerbund and the front panel.
Figure 12:
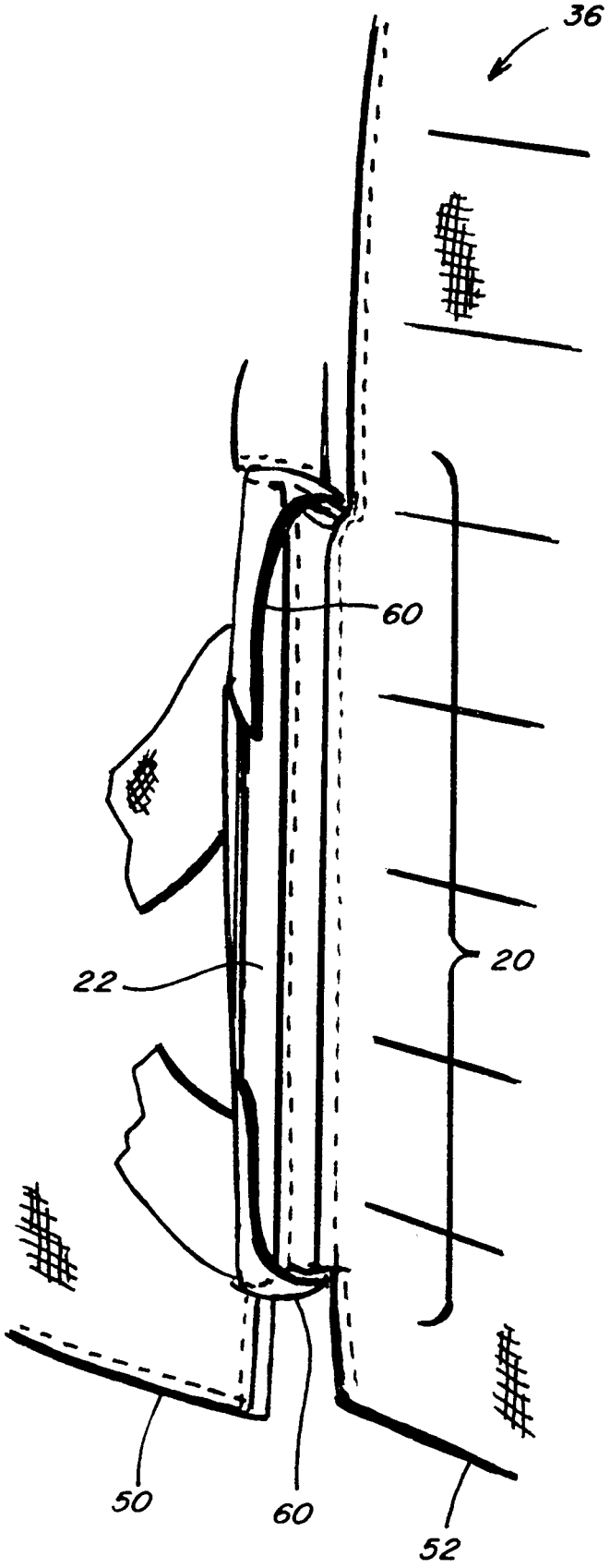
FIG. 12 is still another enlarged fragmentary perspective view of the vest of FIG. 10, showing the apparatus assembled connecting the cummerbund and the front panel.
Figure 13:
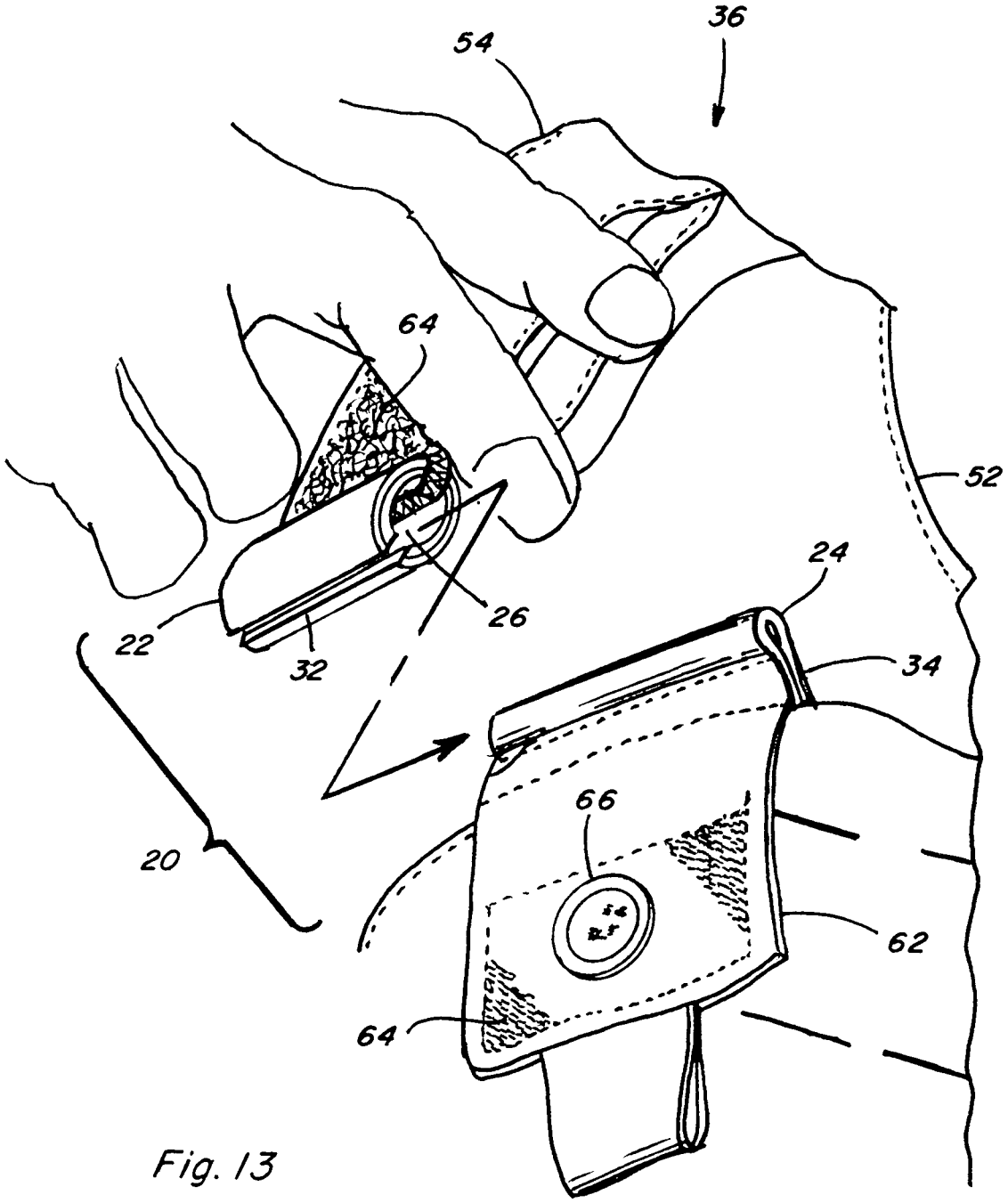
FIG. 13 is an enlarged fragmentary perspective view of the representative vest, showing another embodiment of assembly and release apparatus of the invention, for connecting the front panel to a shoulder strap of the vest.
Figure 14:
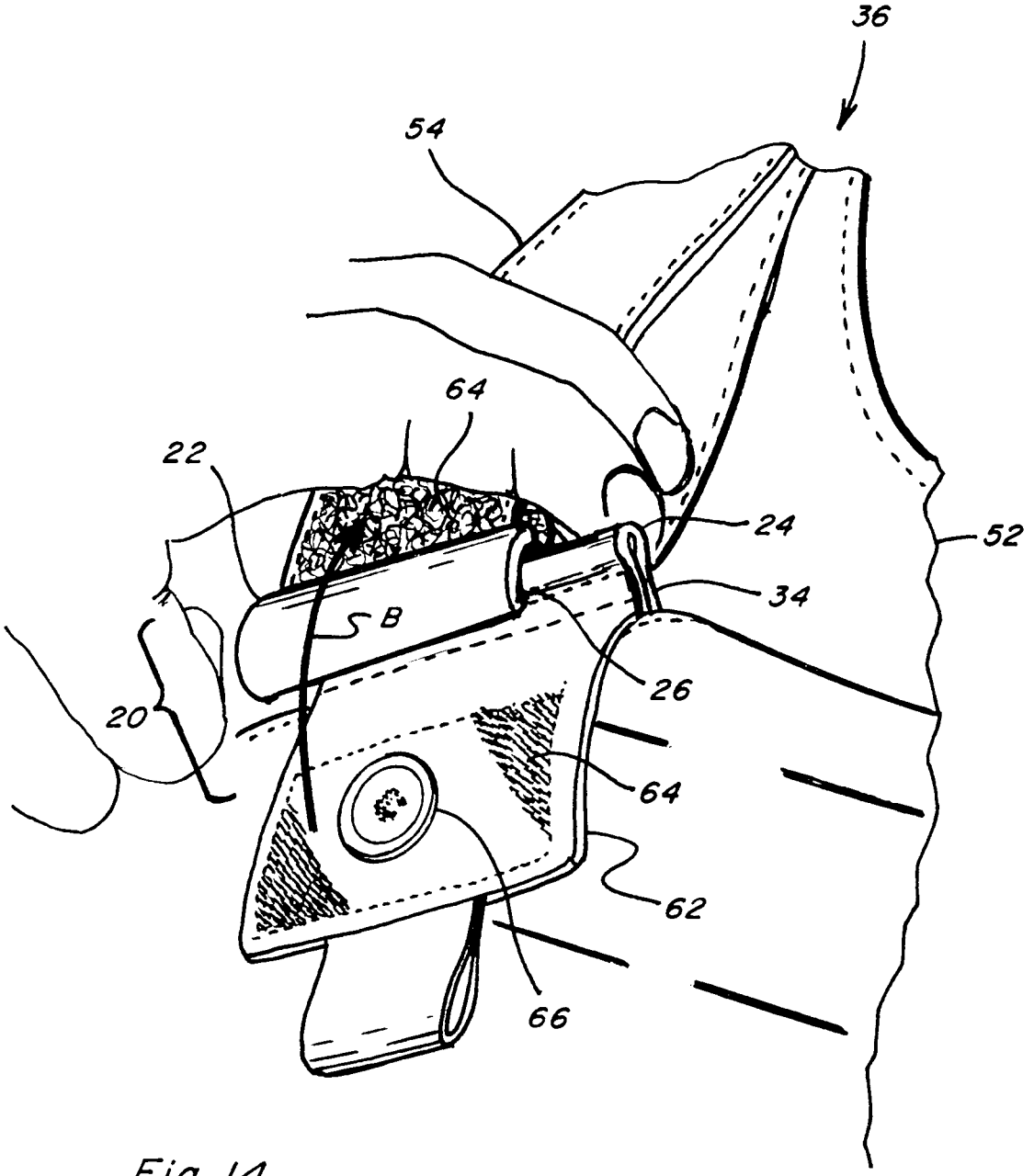
FIG. 14 is another enlarged fragmentary perspective view of the representative vest of FIG. 13, showing the apparatus of the invention partially engaged for connecting the front panel to the shoulder strap.

As detent elements, as shown in FIGS. 11 and 12, covers 60 can be provided in generally covering relation to the longitudinal ends of clip 22, for capturing pin 24 therein and preventing inadvertent or unintended disassembly. When disassembly is desired, the cover 60 at the desired end can be manually moved out of covering relation to the end of the clip to allow passage of the pin. Suitable materials for covers 60 can include, but are not limited to, plastics or fabric, e.g., material available under the Hypalon tradename, natural or synthetic leather, or other material As another non-limiting example, as shown in FIGS. 13 and 14, alternatively, flaps 62 and straps 54 can be provided with suitable detents, in the form of fasteners, such as hook and loop fasteners 64, and/or button snaps 66, engageable by folding or bending flap 62 into overlaying relation to the assembled apparatus 20 and the mating fastener element on strap 54, as denoted by arrow B in FIG. 14, for holding it in the assembled state and preventing longitudinal relative movement of clip 22 and pin 24. Here, it should be noted that at least the disconnection of apparatus 20 should be capable of being accomplished intuitively and easily by a person by feel only and under trying conditions such as darkness, and when muddy or in cold temperatures, so as to not inhibit rapid disconnection and assembly.

Also here, it should be noted that both of the C-clip 22 and pin 24 can be attached to the garment by common elements, such as straps, or sewed to the garment, riveted, and/or other well known attachment means. Either or both can also be covered with fabric material of the garment, as desired or required for a particular application, e.g., for camouflage purposes. As another alternative, clip 22 and pin 24 can be formed of a suitable rigid material such as a polyethylene, or engineered plastics material. The pin 24 can be of solid or tubular construction, as desired or required for a particular application.

As noted above, a garment can include one or more of the attachment and release apparatus 20 of the invention at a particular location, for connecting a particular element of the garment to another at that location. As a non-limiting example, for a vest 36 having a front panel 52, rear panel 56 and a cummerbund 50 or belt, apparatus of the invention 20 can be provided along adjacent side edges, or at desired locations; along a belt; and on the front and rear panels for connecting them together for donning the vest 36. If the vest 36 includes suspenders or shoulder straps 54, apparatus 20 of the invention can be included at one or more of the desired connection locations on or between the shoulder strap or straps and the other element of the vest to be connected, such as the front or rear panels. The apparatus 20 of the invention can also be used for connecting other items to the garment, such as, but not limited to, pouches, canteens, radios, holsters, straps, additional protective panels or elements, and the like (not shown).

Thus, as a method of donning a garment such as vest 36, the pin 24 of a first element of the garment is aligned with the end of the appropriate clip 22, and slid into the clip until fully received and detent element 38 engaged if provided. If an alternative or additional detent element such as cover 60 or flap 62 is used, they are placed or positioned over the ends of the apparatus and engaged and the connection at that location is complete. Then one or more additional connections are made using additional apparatus 20 to completely connect the garment together in the desired configuration. For doffing, particularly for rapid release, the detent elements are withdrawn or opened, and the pin or pins 24 removed from the C-shape clip or clips 22 of the desired apparatus 20. One or more of apparatus 20 may be disconnected as desired or required for a particular situation.

It will be understood that the foregoing descriptions are for preferred embodiments of this invention and that the invention is not limited to the specific forms shown. Other modifications may be made in the design and arrangement of other elements without departing from the scope of the invention as expressed in the appended claims.

What is claimed is:

1. A ballistic vest comprising:

a front panel having a side edge, and a side element, the side element comprising a belt or cummerbund;

an elongate, C-shaped clip defining a longitudinally extending channel open at at least one open end and an open slot facing in a side direction extending along the channel, and including at least one element attaching the C-shaped clip along one of the side element or the side edge of the front panel of the vest;

an elongate pin slidably receivable in the channel of the C-shaped clip through the open end to assemble the C-shaped clip and the pin together to connect the front panel and the side element, the pin having a strip configured to extend in the side direction through the slot and attaching the pin along another of the side element or the side edge of the front panel, the slot being smaller than the pin and the C-shaped clip being strong and rigid to prevent passage of the pin through the slot when a force is exerted to pull the pin and the C-shaped clip apart during use of the vest; and at least one detent element connected in cantilever relation to the C-shaped clip to extend in the side direction between longitudinally spaced portions of the C-shape clip bounding the slot, the detent element having a tab having an engaged state cooperatively received in a notch in the pin for preventing longitudinal movement of the pin in the channel, and a release state pulled from the notch to allow slidably removing the pin longitudinally from the channel through the open end, and a feature connected to the detent element manually graspable to pull the detent element to pull the tab from the notch to allow removal of the pin from the channel to separate the front panel and the side element.

2. The ballistic vest of claim 1, wherein the detent element is located about centrally along the length of the C-shaped clip and overlays the strip.

3. The ballistic vest of claim 1, wherein the detent element extends in the side direction beyond the C-shaped clip.

4. The ballistic vest of claim 1, wherein the vest is donned by sliding the pin into the channel of the C-shaped clip.

5. The ballistic vest of claim 1, wherein the vest is doffed by pulling the feature connected to the detent element to pull the tab from the notch while sliding the pin from the channel of the C-shaped clip.

6. The ballistic vest of claim 1, wherein the feature is connected to the detent element extending downwardly therefrom.

7. The ballistic vest of claim 1, wherein the feature connected to the detent element comprises a loop or cord.

8. The ballistic vest of claim 1, wherein the channel of the C-shaped clip and the pin have mating D-shapes when viewed from the end thereof.

9. The ballistic vest of claim 8, wherein the C-shaped clip and the pin have mating surfaces adjacent to at least one side of the slot, the mating surfaces being tapered at less than a 90 degree angle to the slot such that when the pin is located in the channel and the force is exerted against the strip in the side direction, the mating surface of the clip adjacent to the slot will be drawn toward the slot to prevent passage of the pin therethrough.

10. The ballistic vest of claim 9, comprising the mating surfaces on opposite sides of the channel, respectively.

11. The ballistic vest of claim 10, wherein the detent element is located between longitudinally extending portions of one of the mating surfaces of the C-shaped clip.

12. A ballistic vest comprising:

an elongate first strip attached to a first location on the vest and an elongate second strip attached to a second location on the vest, the first and second elongate strips each having opposite longitudinal end portions and a middle portion therebetween, the longitudinal end portions of the first and second strips being releasably connected together by pinned connections, respectively, to hold the strips in parallel side by side relation and the first location on the vest and the second location on the vest together, each of the pinned connections comprising a longitudinally extending pin attached along a side of one of the strips received in a longitudinally extending channel through a C-shaped clip attached along a side of the other of the strips, the side of the one of the strips extending through a slot of the C-shaped clip facing in a side direction toward the one of the strips to attach to the pin, and the C-shaped clip being rigid and having edge portions bounding the slot such that the slot has a width smaller than the pin to prevent passage of the pin through the slot, the pin being longitudinally removable from the channel by a predetermined relative longitudinal movement of the first and second strips; and a detent element extending in the side direction in cantilever relation from the middle portion of the first strip between longitudinally spaced portions of the C-shaped clip, the detent element overlaying the second strip and comprising a tab having an engaged state cooperatively received in a receptacle in the pin of the second strip to prevent the predetermined relative longitudinal movement of the first and second strips, and the detent element being deformable by being pulled away from the strip to remove the tab from the receptacle to allow the predetermined relative longitudinal movement of the strips.

13. The ballistic vest of claim 12, wherein the channel and the pin have mating D-shapes when viewed longitudinally.

14. The ballistic vest of claim 12, wherein the C-shaped clip and the pin have mating surfaces adjacent to at least one side of the slot tapered at less than a 90 degree angle to the slot such that when the pin is located in the channel and a force is exerted against the strip in a sideward direction, the mating surface of the C-shaped clip adjacent to the slot will be drawn toward the slot.

15. The ballistic vest of claim 14, comprising the mating surfaces on opposite sides of the channel, respectively.

16. The ballistic vest of claim 12, wherein the detent element comprises a manually graspable feature pullable to deform the detent element to remove the tab from the receptacle.

17. The ballistic vest of claim 16, wherein the feature comprises a loop or cord.

18. The ballistic vest of claim 12, wherein the first location on the vest comprises a front panel thereof and the second location comprises a belt or a cummerbund.

19. The ballistic vest of claim 12, wherein the first location on the vest comprises a front panel thereof and the second location comprises a shoulder strap.

20. A ballistic vest, comprising: a C-shaped clip defining a channel and an open slot extending along the channel, the open slot facing in a side direction and open at opposite ends of the C-shaped clip, and including at least one element attaching the C-shaped clip to a first of a front panel or cummerbund of the vest; a pin slidably received in the channel of the C-shaped clip through one of the open ends assembling the C-shaped clip and the pin together, the pin having a tab or strip extending through the slot and attaching the pin to a second of the front panel or cummerbund of the vest such that the pin and the C-shaped clip when assembled join together the front panel and cummerbund, the C-slot being bound by edges of the C-shaped clip and being smaller than a width of the and the C-shaped clip being sufficiently strong and rigid to resist deformation under forces exerted thereagainst during use of the vest with the C-shaped clip and pin assembled to restrain the pin from removal through the channel, the C-shaped clip and the pin having mating surfaces bounding the channel adjacent to at least one side of the slot, including a mating surface on the C-shaped clip adjacent to one side of the slot that faces toward the channel and a mating surface on the pin that faces the slot tapered at less than a 90 degree angle to the slot such that a force exerted against the tab or strip in a the side direction to pull the pin toward the slot will draw the mating surface of the clip adjacent to the one side of the slot toward the slot; and at least one detent element connected in cantilever relation to the C-shaped clip and extending in the side direction between longitudinally spaced portions of one of the edges thereof and bounding the slot, the detent element including a tab cooperatively received in a receptacle in the pin to prevent longitudinal movement of the pin in the channel, and the detent element being pullable in a direction away from the slot to remove the tab from the receptacle to allow slidably removing the pin longitudinally from the channel through one of the open ends.

21. The ballistic vest of claim 20, wherein the channel and the pin have mating D-shapes when viewed longitudinally.

22. The ballistic vest of claim 20, wherein the C-shaped clip and the pin have the mating surfaces bounding the channel adjacent to opposite sides of the slot.

* * * * *